United States Patent [19]

Wilson et al.

[11] 4,046,993

[45] Sept. 6, 1977

[54] TARGET FOR TORPEDO LAUNCH SYSTEM

[75] Inventors: Charles A. Wilson, Oxnard; Patrick J. Moran, Ventura, both of Calif.

[73] Assignee: The United States of America as represented by the Secretary of the Navy, Washington, D.C.

[21] Appl. No.: 700,655

[22] Filed: June 28, 1976

[51] Int. Cl.[2] ..... G06G 7/80

[52] U.S. Cl. ..... 235/61.5 D; 89/1.5 R; 235/61.5 T; 244/14

[58] Field of Search ..... 235/61.5 T, 61.5 E, 235/61.5 D; 89/1.5 R, 1.5 S, 1.5 E; 244/3.21, 14

[56] References Cited

U.S. PATENT DOCUMENTS

| | | | |
|---|---|---|---|
| 2,518,916 | 8/1950 | Luck | 89/1.5 S |
| 3,171,324 | 2/1965 | Ernst et al. | 89/1.5 S |
| 3,699,310 | 10/1972 | Cole | 235/61.5 E |
| 3,860,791 | 1/1975 | Headle | 235/61.5 T |

*Primary Examiner*—Felix D. Gruber

*Attorney, Agent, or Firm*—Richard S. Sciascia; Joseph M. St. Amand; William W. Cochran, II

[57] ABSTRACT

A system for determining the proper instant of time to launch an object, such as a target or torpedo, from an aircraft to cause the object to impact a water surface at a predetermined nose-down angle, thereby preventing structural damage due to high impact forces. The system utilizes signals produced by instrumentation representative of the aircraft pitch and angular rate of pitch. The desired launch altitude and predetermined impact angle are physically set into the system by means of adjustable voltage sources. These parameters are processed in the system such that the system forms a complete electronic analogy to the physical laws which govern the motion of the free falling object. In operation, the system continuously computes the predicted impact angle based on the instantaneous inputs of the aircraft's altitude, pitch angle and pitch rate. It then compares the predicted impact angle with the predetermined impact angle. Whenever the predicted impact angle exceeds the predetermined impact angle, a launch signal is produced to release the object.

8 Claims, 3 Drawing Figures

TARGET FOR TORPEDO LAUNCH SYSTEM

BACKGROUND OF THE INVENTION

The present invention pertains generally to systems for releasing torpedoes from aircraft, and more particularly to a system for determining impact attitude. The conventional method for dropping targets, torpedoes or other objects from an aircraft to the water to cause the object to enter the water's surface at a predetermined nose-down attitude has been to pitch the aircraft to the desired attitude and release the object. In most instances, however, it is either impractical or impossible to hold the aircraft at the desired attitude without angular pitch velocity causing the object to change its attitude before water surface impact. Moreover, when aircraft such as helicopters are used and it is desired to drop the object in a particular location while the helicopter is hovering over that location, the helicopter is unable to hover while maintaining a preselected nose-down attitude. In this case, the helicopter pilot must rotate the helicopter through a pitch angle at an angular velocity which the pilot feels will cause the torpedo to impact the water at the desired nose-down attitude. Because of the uncertainty involved in such a procedure, it is virtually impossible to cause the object to impact the water's surface at a predetermined angle.

SUMMARY OF THE INVENTION

The present invention overcomes the disadvantages and limitations of the prior art by providing an improved target or torpedo launch system. This is accomplished by providing a system which continually computes the predicted impact angles for any predetermined height of the aircraft above the water's surface from pitch angle and rate information. This computed signal is compared with a predetermined impact angle and when the predicted impact angle exceeds the predetermined impact angle, a release signal is generated.

It is therefore an object of the present invention to provide an improved target or torpedo launch system.

It is also an object of the present invention to provide a launch system which is capable of computing launch time for a predetermined impact angle.

Another object of the present invention is to provide a launch system which is capable of computing impact angle with high accuracy.

Another object of the present invention is to provide a launch system which is simple in operation.

Another object of the present invention is to provide a launch system which is capable of launching objects for impact at a predetermined angle with high reliability.

Other objects and further scope of applicability of the present invention will become apparent from the detailed description given hereinafter. The detailed description indicating the preferred embodiment of the invention is given only by way of illustration since various changes and modifications within the spirit and scope of the invention will become apparent to those skilled in the art from the detailed description. The foregoing abstract of the disclosure is for the purpose of providing a non-legal brief statement to serve as a searching and scanning tool for scientists, engineers or researchers, and is not intended to limit the scope of the invention as disclosed herein, nor is it intended to be used in interpreting or in any way limiting the scope or fair meaning of the appended claims.

DETAILED DESCRIPTION OF THE PREFERRED EMBODIMENT

Figure 1:
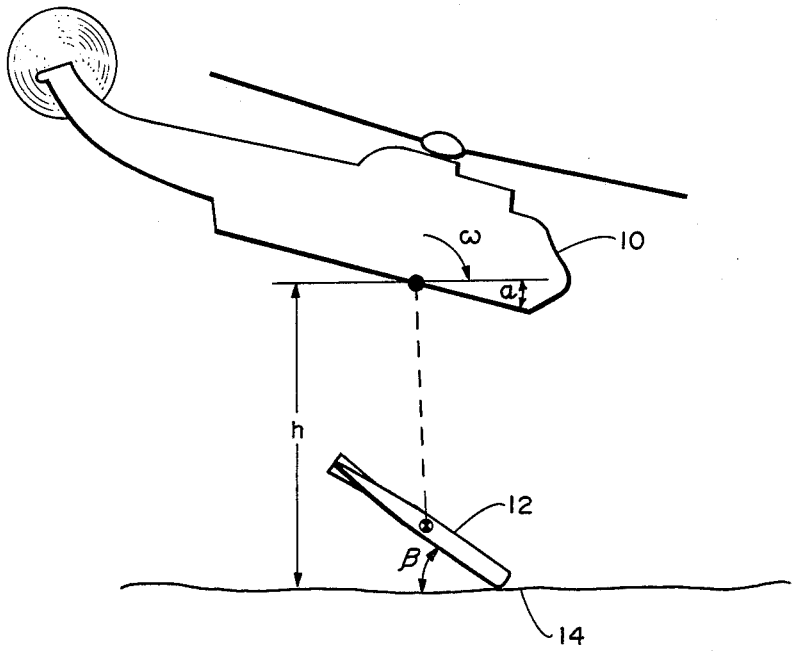
FIG. 1 is a schematic diagram illustrating the parameters of a helicopter launch system.

FIG. 1 schematically illustrates the parameters associated with a launch. As shown, the launch aircraft 10 has a pitch angle ($\alpha$) and is rotating at a pitch rate ($\omega$). The distance between the aircraft and the water surface is $h$. The angle ($\beta$) of impact between the object 12 and the water surface 14 constitutes the object's nose-down attitude. This angle ($\beta$) is dependent upon two factors, i.e., the pitch angle ($\alpha$) at which the target is released from the helicopter, and the angle the target rotates through while dropping from the aircraft 10 to the water surface 14. The latter factor is a product of the initial pitch rate ($\omega$) multiplied by the period of time between release and impact. This is mathematically shown by the equation:

$$\beta = \alpha + \omega \tag{1}$$

where $\beta$ is the target nose-down attitude at impact, $\alpha$ is the pitch angle at release, $\omega$ is the pitch rate, and $t$ is the drop time.

The drop time, in turn, is dependent upon the distance the target has to drop and is given by the equation:

$$t = \sqrt{2h/g}\,, \tag{2}$$

where h = the drop height, and g = the gravitational constant.

The parameters can therefore be related by the following equation:

$$\beta = \alpha + c\omega\sqrt{h} \tag{3}$$

where $c$ = a constant, $\sqrt{2/g}$.

This equation provides a close approximation of the impact attitude of the target and is utilized by the system of the preferred embodiment of the invention to continuously compute predicted impact attitude.

Figure 2:
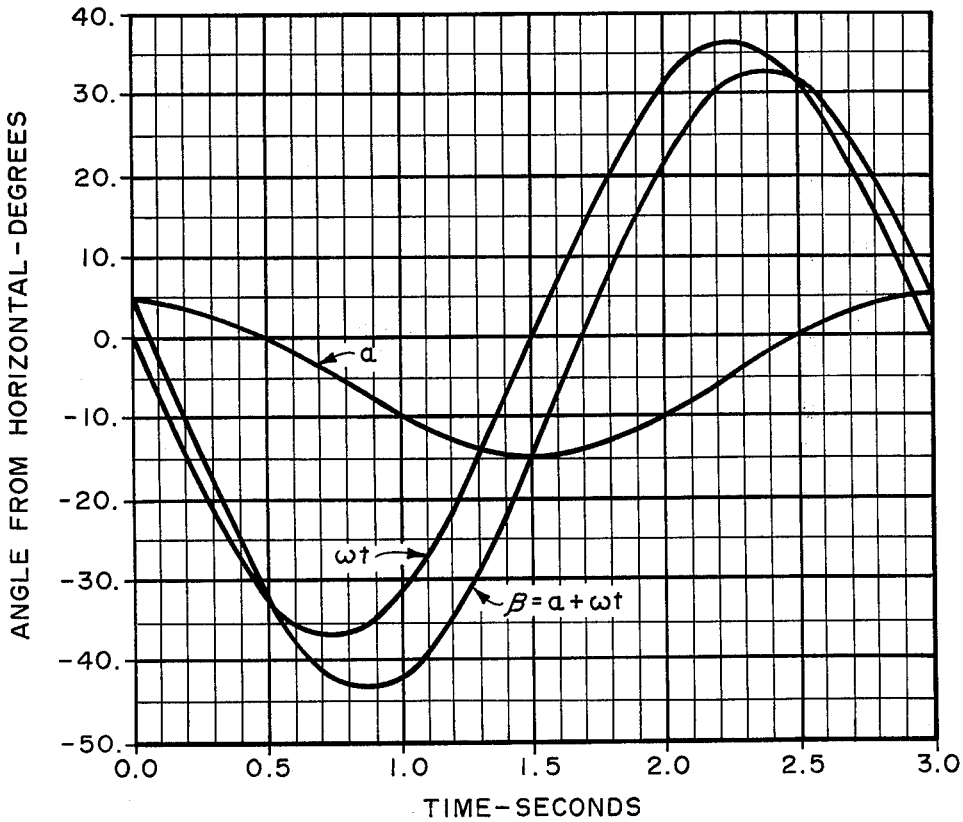
FIG. 2 is a graph of a set of hypothetical parameters.

FIG. 2 is a graph of angular displacement in degrees versus time, illustrating the parameters in a typical launch situtation. The ($\alpha$) curve represents the helicopter horizontal pitch angle during a typical launch maneuver. The pitch angle ($\alpha$) ranges from a nominal flight attitude of 5° nose up to a maximum pitch angle 15° nose down. The duration of the launch cycle from the initiation of the pitch over maneuver to full recovery is 3 seconds.

The slope of the ($\alpha$) curve is equal to the pitch rate ($\omega$). For any preselected altitude for the aircraft 10 above the water surface 14, h is constant in equation (3). Therefore, the second term in equation (3) is proportional to ($\omega$). For a preselected altitude of 50 feet, this term is shown in FIG. 2. The ($\beta$) curve, additionally shown in FIG. 2, is the algebraic sum of the other two curves and represents the instantaneous target impact angle.

For a desired impact attitude of 35°, a release signal is initiated at 0.55 seconds into the launch maneuver. The launch signal is initiated at this point and has a duration of 0.65 seconds, i.e., 1.2 seconds into the launch maneuver, before termination when the attitude drops below 35°. The system is designed such that the minimum duration of the launch signal resulting in target release is 50 milliseconds. Thus, in the example shown, ample time is available to complete the automatic launch sequence.

Figure 3:
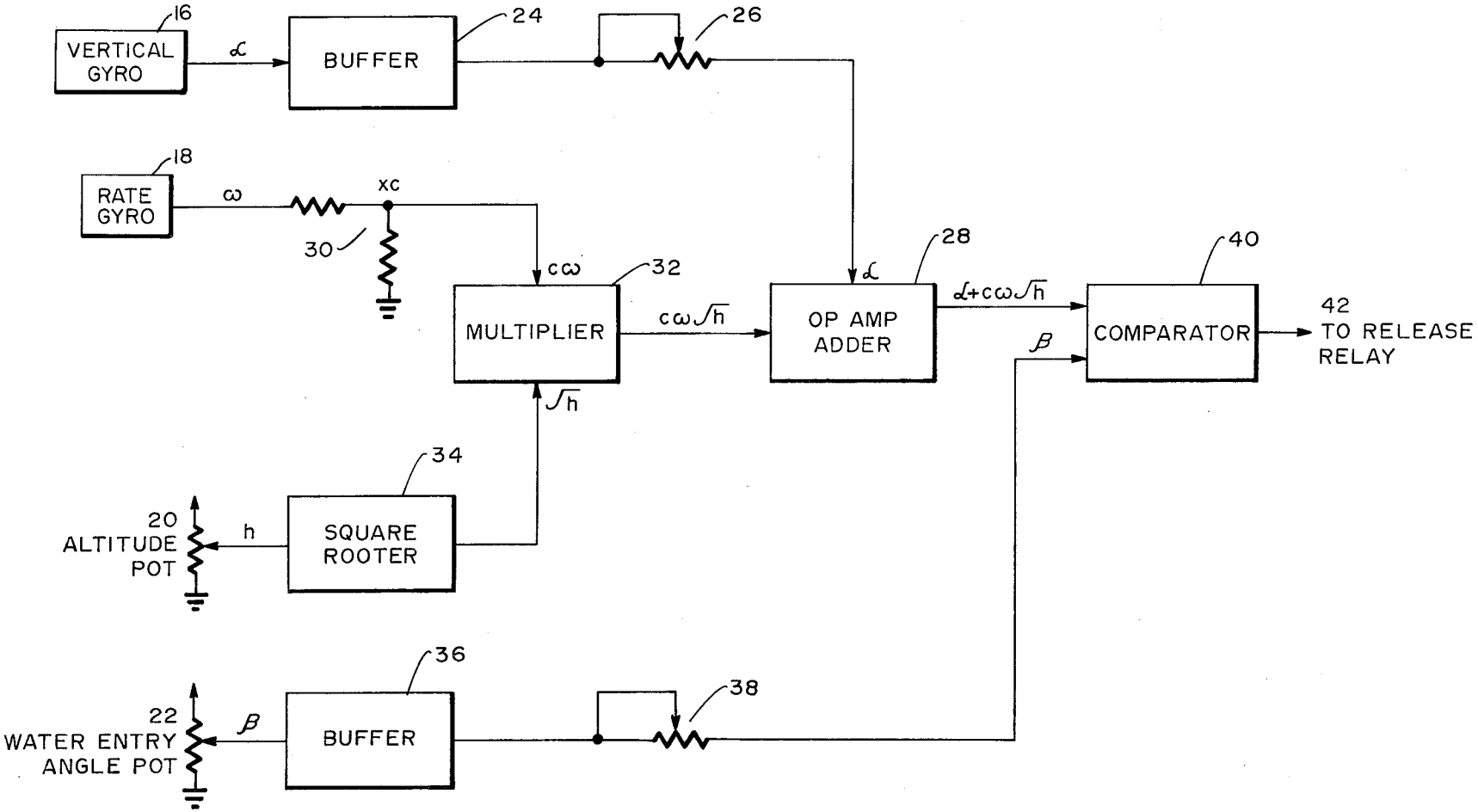
FIG. 3 is a block diagram of the preferred embodiment of the invention.

FIG. 3 is a block diagram in the peferred embodiment of the invention. Vertical gyro 16 and rate gyro 18 produce electrical signals representative of and proportional to the pitch angle ($\alpha$) and pitch rate ($\omega$), respectively, of the aircraft 10 during a launch maneuver. The height ($h$) of the aircraft above the water is produced by the altitude potentiometer 20 while the desired impact angle ($\beta$) is produced by the water entry angle potentiometer 22. A buffer 24 is used to impedance isolate the circuitry of the launch system from the vertical gyroscope 16. Gain control potentiometer 26 is used to adjust the output signal of the buffer to the desired magnitude for ($\alpha$). Constant multiplier 30, in a similar manner, is used to multiply the pitch rate ($\omega$) to compensate for various constants, as set forth in equation (3). Square rooter 34 produces a signal proportional to the square root of the preset altitude on altitude potentiometer 20. Multiplier 32 multiplies the output of the constant multiplier and square rooter to produce a signal representative of the second term on the right side of equation (3). This signal is added to ($\alpha$) in operational amplifier adder 28 to produce a signal which, at any instant of time, represents the predicted target impact angle, i.e., the angle of impact if the target were released instantaneously. The signal representative of the predetermined impact angle ($\omega$) produced by water entry angle potentiometer 22 is impedance isolated from the comparator 40 by buffer 36, and gain adjusted in gain control potentiometer 38. The predetermined impact angle ($\alpha$) and the predicted target impact angle produced at the output of operational amplifier adder 28 are applied to comparator 40. Whenever the predicted target impact angle exceeds the predetermined impact angle ($\beta$), the comparator 40 produces an output which signals a release relay 42 to launch the target. In this manner, the target is released at the proper instant to impact the water at the predetermined impact angle.

The system therefore provides an automatic method of assuring impact of an object with a surface at a predetermined impact angle. This function is performed automatically by the device and requires little or no skill by the operating pilot as previously required to cause a torpedo or other object to enter the water at any desired angle.

Obviously many modifications and variations of the present invention are possible in light of the above teachings. It is therefore to be understood that within the scope of the appended claims the invention may be practiced otherwise than as specifically described.

What is claimed is:

1. A system for launching an object from an aircraft over a relatively flat surface area such that said object impacts said surface area at a predetermined angle comprising:

a. means for producing a signal representative of pitch angle of said aircraft;

b. means for producing a signal proportional to angular velocity of said pitch angle of said aircraft;

c. means for producing a signal representative of the square root of a preselected launch height of said aircraft over said surface area;

d. means for multiplying said signal proportional to angular velocity of said pitch angle of said aircraft by said signal representative of the square root of said preselected launch height of said aircraft over said surface area to produce a time angle rotation signal;

e. means for adding said time angle rotation signal to said signal representative of pitch angle of said aircraft to produce a signal which is continuously representative of predicted object impact attitude with said surface area;

f. means for producing a signal representative of said predetermined angle; and g. means for comparing said signal representative of predicted object impact attitude with said signal representative of said predetermined angle to produce an object release signal whenever said signal representative of predicted object impact attitude exceeds said signal representative of said predetermined angle.

2. The system of claim 1 wherein said means for producing a signal representative of the square root of said preselected launch height comprises an adjustable voltage source and a square rooter.

3. The system of claim 1 wherein said means for producing a signal representative of said predetermined angle comprises an adjustable voltage source, an impedance buffer and a gain control potentiometer.

4. The system of claim 2 wherein said means for producing a signal representative of said predetermined angle comprises an adjustable voltage source, an impedance buffer and a gain control potentiometer.

5. The system of claim 1 wherein said means for adding comprises an operational amplifier which provides impedance isolation.

6. The system of claim 1 wherein said means for producing a signal representative of pitch angle of said aircraft comprises a vertical gyroscope, an impedance buffer, and a gain control potentiometer.

7. The system of claim 1 wherein said means for producing a signal proportional to angular velocity of said pitch angle of said aircraft comprises a rate gyroscope and a constant multiplier.

8. The system of claim 6 wherein said means for producing a signal proportional to angular veocity of said pitch angle of said aircraft comprises a rate gyroscope and a constant multiplier.

* * * * *